US006774098B2

(12) United States Patent
Taylor

(10) Patent No.: US 6,774,098 B2
(45) Date of Patent: Aug. 10, 2004

(54) METHODS FOR REMOVING STAINS FROM FABRICS USING TETRAPOTASSIUM EDTA

(75) Inventor: Lawnle H. Taylor, Germantown, MD (US)

(73) Assignee: LHTaylor Associates, Germantown, MD (US)

( * ) Notice: Subject to any disclaimer, the term of this patent is extended or adjusted under 35 U.S.C. 154(b) by 87 days.

(21) Appl. No.: 10/337,896

(22) Filed: Jan. 8, 2003

(65) Prior Publication Data

US 2004/0087468 A1 May 6, 2004

Related U.S. Application Data

(60) Provisional application No. 60/423,978, filed on Nov. 6, 2002.

(51) Int. Cl.[7] ..... C11D 3/30

(52) U.S. Cl. ..... 510/283; 510/276; 510/281; 510/432; 510/480

(58) Field of Search ..... 510/276, 281, 510/283, 432, 480

(56) References Cited

U.S. PATENT DOCUMENTS

| | | | | |
|---|---|---|---|---|
| 5,287,960 A | | 2/1994 | Kalb et al. | |
| 5,814,591 A | | 9/1998 | Mills et al. | |
| 5,830,839 A | * | 11/1998 | Scepanski | 510/305 |
| 5,872,090 A | | 2/1999 | You et al. | |
| 5,877,315 A | | 3/1999 | Deline et al. | |
| 5,904,735 A | * | 5/1999 | Gutierrez et al. | 8/137 |
| 5,972,876 A | * | 10/1999 | Robbins et al. | 510/423 |
| 5,997,585 A | | 12/1999 | Scialla et al. | |
| 6,004,916 A | | 12/1999 | Mills et al. | |
| 6,200,941 B1 | | 3/2001 | Strandburg et al. | |
| 6,214,784 B1 | | 4/2001 | Robbins et al. | |
| 6,277,153 B1 | | 8/2001 | Van Kouwen et al. | |
| 6,468,954 B2 | | 10/2002 | Levitt et al. | |

OTHER PUBLICATIONS

Church & Dwight Co., Inc. Consumer Products, Specialty Products, Material Safety Data Sheet,Scrub Free Mildew Stain Remover, Issue Date Jul. 10, 2002, pp 5.

Clorox Bleach for Institutional Use, MSDS Safety Information, Item name: Sodium Hypochlorite Solution, pp. 5.

Specialty Hypochlorites vs. Commodity Bleach, Which Should You Be Using?, the Olin Corporation, pp 4.

The Chlorine Institute, Sodium Hypochlorite Manual, May 2000, pp. 71.

The Clorox Company, Material Safety Data Sheet, Tilex Instant Mildew Remover, p. 1.

Jeff Kempter, sodium/calcium hypchlorite (Clorox, bleach) Chemical Fact Sheet 2/86, pp. 4.

* cited by examiner

*Primary Examiner*—Charles Boyer
(74) *Attorney, Agent, or Firm*—Raymond Van Dyke; Nixon Peabody, LLP

(57) ABSTRACT

Methodologies and equipment for using hard surface cleaners to remove stains, such as menstrual fluid stains or underarm perspiration stains, from clothes or other soft fabrics. Suitable hard surface cleaners include Scrubbing Bubbles Mildew Stain Remover®, Tilex Mildew Remover®, Lysol Mildew Remover®, Scrub Free Mildew Stain Remover®, and other common household hard surface cleaners. In one embodiment, the stain removal requires little or no scrubbing of the fabric article.

8 Claims, No Drawings

METHODS FOR REMOVING STAINS FROM FABRICS USING TETRAPOTASSIUM EDTA

This application claims priority from the U.S. Provisional Application Serial No. 60/423,978, filed Nov. 6, 2002, entitled "A SUBCLASS OF AQUEOUS, HARD SURFACE CLEANERS USED IN A NEW AND UNOBVIOUS SOFT SURFACE CLEANING APPLICATION," which is incorporated herein by reference.

TECHNICAL FIELD

This invention relates to methods and equipment for using hard surface cleaners to remove stains, such as menstrual fluid stains or underarm perspiration stains, from clothes or other soft fabrics.

BACKGROUND

Menstrual fluid, a composition of blood and endometrial cells, is difficult to remove from cotton panties once it has stained the fabric. Clorox® Bleach, which is a designated trademark used by the Clorox Company, is one of the leading household products used for the purpose of cleaning white cotton panties of menstrual fluid stain. However, like other chlorine-releasing bleaches, Clorox Bleach, even diluted, will disintegrate the fabric in time because these processes require lengthy immersed soaking of the stain. Even after soaking, a dark residue stain still may remain in the cotton fabric, the removal of which usually necessitates scrubbing. In turn, vigorous scrubbing accelerates deterioration of the bleach-weakened cotton fibers which, again, leads to damaged panties and, expense and frustration. Some household products, such as hydrogen peroxide, produce free oxygen to dislodge menstrual fluid discharge from cotton fabric but this process may be effective only when the discharge is fresh and minimal fluid penetration of the fabric has occurred.

Perspiration stain in the underarm areas of white cotton fabric shirts and blouses is difficult to remove even for professionals in the garment laundry and cleaner business. Often the stain is not completely removed.

There is a clamor among women around the world for a process that they can use to remove fresh, set-in or old menstrual fluid stain or perspiration stain from white cotton fabric, and that can do so easily, rapidly, with little or no scrubbing, and with no damage to the cotton fabric.

SUMMARY OF THE INVENTION

One object of the present invention is to provide methods of using hard surface cleaners to remove fresh, set-in or old menstrual fluid stains or underarm perspiration stains from fabrics. The hard surface cleaners may be store-bought products that are readily available to the public. The fabrics may be, for example, panties, shirts, blouses, or other soft fabric articles. The fabrics may be made of cotton or cotton/polyester. The removal preferably is accomplished with little or no scrubbing of the fabrics.

The methods of the present invention can also be used for removing other stains from fabrics. These stains may be caused, for example, by wine, grass, urine, feces, and certain types of ink, but these are not to be considered limiting.

In accordance with one aspect of the present invention, a method is provided that is useful for removing a stain from a soft fabric article. The method includes the steps of: (a) providing a hard surface cleaner; and (b) contacting the hard surface cleaner to the stain for one to five minutes, typically.

The hard surface cleaner may be a mold or mildew remover, such as Scrubbing Bubbles Mildew Stain Remover®, Tilex Mildew Remover®, Lysol Mildew Remover®, and Scrub Free Mildew Stain Remover®. Scrubbing Bubbles Mildew Stain Remover®, Tilex Mildew Remover®, Lysol Mildew Remover®, and Scrub Free Mildew Stain Removers are designated trademarks used by SC Johnson, the Clorox Company, Reckitt Benckiser Inc., and Church & Dwight Company, Inc, respectively.

In one embodiment, the stain is a menstrual fluid stain or an underarm perspiration stain. The fabric article may be a cloth, and made of white cotton or a blend of white cotton and polyester. The cloth may be selected from the group consisting of panty, shirt, blouse, pant, jean and trousers.

In another embodiment, the hard surface cleaner comprises: (a) a surfactant system consisting of amine oxides within the general formula (I):

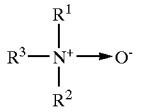

or quaternary amine salts within the general formula (II):

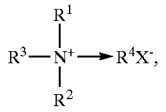

or combinations of the foregoing amine oxides and quaternary amine salts; and (b) a very slightly water-soluble polar organic compound having a water solubility ranging from about 0.1 to 1.0 weight percent, a weight ratio of the very slightly water-soluble polar organic compound to the surfactant system ranging from about 0.1:1 to about 1: 1, wherein $R^1$ and $R^2$ are the same or different and are selected from the group consisting of methyl, ethyl, propyl, isopropyl, hydroxyethyl and hydroxypropyl, $R^3$ is selected from the group consisting of straight chain alkyls, branched chain alkyls, straight chain heretroalkyls, branched chain heteroalkyls and alkyl ethers, each having from about 10 to 20 carbon atoms, $R^4$ is selected from the group consisting of alkyl groups having from 1 to about 5 carbon atoms, and X is a halogen atom.

In yet another embodiment, the hard surface cleaner comprises:(a) either (i) a combination of a nonionic surfactant and a quaternary ammonium surfactant or (ii) an amphoteric surfactant, the total amount of the surfactant being present from about 0.001–10%, wherein the nonionic surfactant is selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides; (b) no more than 50% of at least one water-soluble or dispersible organic solvent having a vapor pressure of at least 0.001 mm Hg at 25° C.; (c) 0.01–25% of tetraammonium ethylenediamine-tetraacetate (tetraammonium EDTA) as a chelating agent; and (d) water.

In still yet another embodiment, the hard surface cleaner comprises (a) a surfactant selected from the group consisting of anionic, nonionic surfactants, and mixtures thereof, with optionally, a quaternary ammonium surfactant, the total amount of surfactant being present from about 0.001–10% by weight; (b) at least one water-soluble or dispersible organic solvent having a vapor pressure of at least 0.001 mm Hg at 25° C., the at least one organic solvent being selected from the group consisting of alkanols, diols, glycol ethers, and mixtures thereof present in an amount from about 1% to 50% by weight of the cleaner; (c) tetrapotassium ethylenediamine-tetraacetate (potassium EDTA) as a chelating agent, the potassium EDTA present from about 0.01–25% weight-of the cleaner; and (d) water.

In still another embodiment, the hard surface cleaner comprises (a) a nonionic surfactant with optionally, a quaternary ammonium surfactant, the total amount of the surfactant being present from about 0.001–10%, wherein the nonionic surfactant is selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides; (b) no more than 50% of at least one water-soluble or dispersible organic solvent having a vapor pressure of at least 0.001 mm Hg at 25° C.; (c) 0.01–25% of tetraammonium ethylenediamine-tetraacetate (tetraammonium EDTA) as a chelating agent; and (d) water.

In a preferred embodiment, the hard surface cleaner has a viscosity of less than about 100 cps and comprises: (a) at least about 85% water, in which is dissolved (b) at least about 0.45 equivalent per kilogram of an inorganic anion which, when combined with calcium ion, forms a salt which has a solubility of not more than 0.2 g/100 g water at 25° C., wherein the anion is carbonate, fluoride, or metasilicate ion, or a mixture of such anions, (c) at least 0.3% by weight, based on the weight of the composition, of a detersive surfactant including an amine oxide of the form $RR^1R^2N\rightarrow O$ wherein R is $C_6$–$C_{12}$ alkyl and $R^1$ and $R^2$ are independently $C_{1-4}$ alkyl or $C_{1-4}$ hydroxyalkyl, and (d) at least about 0.5 weight percent of a bleach, based upon the weight of the composition, wherein the cleaning composition is alkaline and essentially free of chelating agents, phosphorous-containing salt, and abrasive.

In accordance with another aspect of the present invention, a kit is provided that is useful for removing stains from clothes or other soft fabrics. The kit has an instruction indicating that the hard surface cleaner can be used for removing stains, such as menstrual fluid stains or perspiration stains, from soft fabric articles.

Other features, objects, and advantages of the present invention are apparent in the detailed description that follows. It should be understood, however, that the detailed description, while indicating preferred embodiments of the invention, are given by way of illustration only, not limitation. Various changes and modifications within the scope of the invention will become apparent to those skilled in the art from the detailed description.

DETAILED DESCRIPTION

The present invention is based on the surprising discovery that hard surface cleaners can effectively remove stains from clothes or other soft fabrics, notably menstrual fluid stains and underarm perspiration stains. Soft fabrics suitable for the present invention can be made of a variety of materials, such as cotton or cotton/polyester. They preferably are in white. Soft Examples of suitable soft fabrics include, but are not limited to, panties, shirts, blouses, pants, jeans, trousers, and other wear and bed products.

Preferred hard surface cleaners for the present invention include off-the-shelf bathroom cleaners regularly used for removing mold and mildew from hard surfaces, such as tile and countertop grouting. Scrubbing Bubbles Mildew Stain Remover (manufactured by SC Johnson), Tilex Mildew Remover (manufactured by the Clorox Company), Lysol Mildew Remover (manufactured by Reckitt Benckiser Inc.), and Scrub Free Mildew Stain Remover (manufactured for Church & Dwight Company, Inc.) are examples of these commercial bathroom cleaners. The product labels and/or use instructions warn against using these mildew removers on clothes or fabrics.

The off-the-shelf hard surface cleaners can be used as purchased for the removal of menstrual fluid stains, underarm perspiration stains or other stains by atomized spray application, without dilution or other modifications. In certain cases, the household hard surface cleaners are superior to the traditional laundry bleaches for the purpose of removing menstrual fluid or underarm perspiration stains from cotton or cotton/polyester fabric articles.

Other examples of hard surface cleaners suitable for the present invention include those disclosed in U.S. Pat. Nos. 5,573,710, 5,814,591, 5,972,876, 6,004,916, 6,200,941, and 6,214,784, all of which are incorporated herein by reference. These U.S. patents do not suggest using the disclosed hard surface cleaners to remove stains from clothes or other soft fabric articles. Furthermore, some products employing the technology disclosed in these patents, e.g. Scrubbing Bubbles Mildew Stain Remover, expressly indicate in their instructions for use that hard surface cleaners are not to be used to remove stains from clothes or other soft fabric articles.

U.S. Pat. No. 5,573,710 discloses an aqueous multiple-surface cleaning composition which can be used for the removal of grease and stains from hard surfaces or hard fibrous substrates such as carpet and upholstery. The composition contains (a) a surfactant system consisting of amine oxides within the general formula (I):

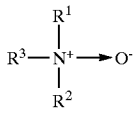

or quaternary amine salts within the general formula (II):

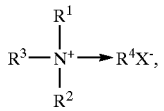

or combinations of the foregoing amine oxides and quaternary amine salts; and (b) a very slightly water-soluble polar organic compound. The very slightly water-soluble polar organic compound may have a water solubility ranging from about 0.1 to 1.0 weight percent, and the weight ratio of the very slightly water-soluble polar organic compound to the surfactant system may range from about 0.1:1 to about 1:1. $R^1$ and $R^2$ may be selected from the group consisting of methyl, ethyl, propyl, isopropyl, hydroxyethyl and hydroxypropyl. $R^1$ and $R^2$ may be the same or different. $R^3$ may be selected from the group consisting of straight chain alkyls, branched chain alkyls, straight chain heretroalkyls, branched chain heteroalkyls and alkyl ethers, each having from about 10 to 20 carbon atoms. $R^4$ may be selected from the group consisting of alkyl groups having from 1 to about 5 carbon atoms. X is a halogen atom.

In certain cases, the composition further includes a water soluble organic compound in an amount effective to reduce streaking. The water soluble organic compound may be selected from water soluble glycol ethers and water soluble alkyl alcohols. The water soluble organic compound may have a water solubility of at least 14.5 weight percent. The weight ratio of the surfactant system to the water soluble organic compound may range from about 0.033:1 to about 0.2:1.

U.S. Pat. No. 5,814,591 describes an aqueous hard surface cleaner with improved soil removal. The cleaner includes (a) either (i) a nonionic, an amphoteric surfactant, or a combination thereof, or (ii) a quaternary ammonium surfactant, the surfactants being present in a cleaning-effective amount; (b) at least one water-soluble or dispersible organic solvent having a vapor pressure of at least 0.001 mm Hg at 25° C., the at least one organic solvent present in a solubilizing- or dispersion-effective amount; (c) ammonium ethylenediamine-tetraacetate (ammonium EDTA) as a chelating agent, the ammonium EDTA present in an amount effective to enhance soil removal in the cleaner; and (d) water. The total surfactant maybe present in an amount from about 0.001–10%. In a concentrated product, the surfactant may be present up to 20% by weight. The nonionic surfactant may be selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides. The at least one water-soluble or dispersible organic solvent may be present in an amount of no more than 50% by weight of the cleaner. The ammonium EDTA may be a tetraammonium EDTA and present in an amount of about 0.01–25% by weight of the total cleaner.

U.S. Pat. No. 5,972,876 discloses an aqueous hard surface cleaner comprising (a) a surfactant selected from the group consisting of anionic, nonionic surfactants, and mixtures thereof, with optionally, a quaternary ammonium surfactant, the total amount of surfactant being present in a cleaning-effective amount; (b) at least one water-soluble or dispersible organic solvent having a vapor pressure of at least 0.001 mm Hg at 25° C., the organic solvent being present in a solubilizing- or dispersion-effective amount; (c) tetrapotassium ethylenediamine-tetraacetate (potassium EDTA) as a chelating agent, the potassium EDTA present in an amount effective to enhance soil removal in the cleaner; and (d) water. The total amount of surfactant may be present from about 0.001–10% by weight. The at least one organic solvent may be selected from the group consisting of alkanols, diols, glycol ethers, and mixtures thereof, and is present in an amount from about 1% to 50% by weight of the cleaner. The potassium EDTA may be present from about 0.01–25% weight-of the cleaner.

U.S. Pat. No. 6,004,916 discloses an aqueous, hard surface cleaner which contains (a) either a nonionic or amphoteric surfactant with optionally, a quaternary ammonium surfactant, the surfactants being present in a cleaning-effective amount; (b) at least one water-soluble or dispersible organic solvent having a vapor pressure of at least 0.001 mm Hg at 25° C., the at least one organic solvent present in a solubilizing- or dispersion-effective amount; (c) ammonium ethylenediamine-tetraacetate (ammonium EDTA) as a chelating agent, the ammonium EDTA present in an amount effective to enhance soil removal in the cleaner; and (d) water. The surfactant may be a nonionic surfactant with optionally, a quaternary ammonium surfactant. The nonionic surfactant may be selected from the group consisting of an alkoxylated alkylphenol ether, an alkoxylated alcohol, or a semi-polar nonionic surfactant which itself is selected from the group consisting of mono-long-chain alkyl, di-short-chain trialkyl amine oxides, alkylamidodialkyl amine oxides, phosphine oxides and sulfoxides. The total amount of the surfactant may be present from about 0.001–10%. The at least one water-soluble or dispersible organic solvent may be present in an amount of no more than 50% by weight of the cleaner. The ammonium EDTA may be a tetraammonium EDTA which is present in an amount from 0.01–25% by weight of the total cleaner.

U.S. Pat. No. 6,200,941 discloses a diluted hard surface cleaning composition. The cleaning composition contains (a) at least about 85% water, in which is dissolved (b) at least about 0.45 equivalent per kilogram of an inorganic anion which, when combined with calcium ion, forms a salt which has a solubility of not more than 0.2 g/100 g water at 25° C.; (c) at least 0.3% by weight, based on the weight of the composition, of a detersive surfactant. The composition preferably has a viscosity of less than about 100 cps. The anion may be carbonate, fluoride, or metasilicate ion, or a mixture of such anions. The detersive surfactant may include an amine oxide of the form $RR^1R^2N\rightarrow O$ wherein R is $C_6$–$C_{12}$ alkyl and $R^1$ and $R^2$ are independently $C_{1-4}$ alkyl or $C_{1-4}$hydroxyalkyl. The composition may further contain at least about 0.5 weight percent of a bleach, based upon the weight of the composition. In one case, the cleaning composition is alkaline and essentially free of chelating agents, phosphorous-containing salt, and abrasive.

U.S. Pat. No. 6,214,784 describes a composition similar to that disclosed in U.S. Pat. No. 5,972,876. The composition may include dipotassium carbonate as a buffer.

In accordance with one aspect of the present invention, a method is provided that is useful for removing stains from cotton or cotton/polyester clothes or fabric articles. The clothes or fabric articles preferably are in white. The method includes first soaking the stained fabric article in cold water until the stain areas are thoroughly saturated with water. The stains may be menstrual fluid stain or perspiration stain. The fabric article can be swirled around in the water to dislodge as much menstrual fluid as possible. For article(s) heavily soiled with menstrual fluid, the water may be changed to repeat the soaking and swirling step.

The fabric article is then removed from water. Heavily soiled white cotton articles may be tinted slightly pink after this step. The stained areas are arranged for maximal exposure in preparation for the spray with an aqueous, hard surface cleaner. Suitable aqueous, hard surface cleaners include Scrubbing Bubbles Mildew Stain Remover, Tilex Mildew Remover, Lysol Mildew Remover and Scrub Free Mildew Stain Remover, which can be obtained off-the-shelf of a food market, or those disclosed in U.S. Pat. Nos. 5,573,710, 5,814,591, 5,972,876, 6,004,916, 6,200,941, and 6,214,784.

The aqueous, hard surface cleaner can be sprayed on the stain areas, or the entire article if necessary. After spraying, the stain areas can be compressed and confined into a small container to saturate and soak the stain areas or the entire article in the cleaner. In one instance, two pairs of panties can fit entirely into a pint-sized plastic container.

The stained areas are soaked with the hard surface cleaner until stain has been removed. This may require about one minute to five minutes for fresh menstrual fluid stain, and about thirty minutes to an hour for old underarm perspiration stain. The fabric article is subsequently inspected for any remaining stain. If necessary, spot spray can be applied again to remove the remaining stain.

After all stain has been removed, the fabric article is thoroughly rinsed in cold water before being put through the wash and dry cycle, particularly if the fabric article is combined with non-colorfast clothing in the wash. According to the present invention, menstrual fluid stains or underarm perspiration stains may be removed from a fabric article with little or no scrubbing of the article.

For in-place removal of small menstrual fluid stain spots from white sheets, an absorbent white toweling may be located underneath the spots. A small amount of spray is applied and confined to the spotted areas. After stain is gone, the treated areas may be dampen with wet cloth to remove the spray product and then allow the areas to dry.

The treated fabric article preferably is not combined with non-colorfast clothing without first rinsing the treated article thoroughly in cold water. After stain is removed, the fabric article preferably is not soaked with the cleaner any longer than necessary. In certain cases, if the cleaner is allowed to remain in contact with the fabric article when machine-dried, a pale tint may be left, although the tint can be removed by repeating the process of the present invention.

In addition to menstrual fluid stains and perspiration stains, the present invention can be used to remove other stains from fabric articles. These stains include, but are not limited to, wine, grass, urine, feces, or ink stains.

The present invention contemplates any aqueous cleaner that consists of the ingredients and properties characteristic of hard surface cleaners, including combinations or modifications thereof. These aqueous cleaners can be used for the removal of stains from panties, shirts, blouses, or other soft fabric articles.

In accordance with another aspect of the present invention, a kit is provided that is useful for removing stains from clothes or other soft fabrics. The kit includes a container which encloses a hard surface cleaner. Any hard surface cleaner suitable for removing menstrual fluid stains or underarm perspiration stains may be included in the kit of the present invention. The container has an instruction which indicates that the enclosed hard surface cleaner can be used for removing stains, such as menstrual fluid and perspiration stains, from clothes or other soft fabrics. In one embodiment, the hard surface cleaner enclosed in the container comprises Scrubbing Bubbles Mildew Stain Remover. In another embodiment, the hard surface cleaner comprises Tilex Mildew Remover. In yet another embodiment, the hard surface cleaner comprises Lysol Mildew Remover. And, again, another embodiment, the hard surface cleaner comprises Scrub Free Mildew Stain Remover.

It should be understood that the above-described embodiments and the following example are given by way of illustration, not limitation. Various changes and modifications within the scope of the present invention will become apparent to those skilled in the art from the present description.

EXAMPLE

Comparison of Scrubbing Bubbles Mildew Stain Remover, Tilex Mildew Remover, Lysol Mildew Remover and Scrub Free Mildew Stain Remover to Clorox Bleach for the Removal of Menstrual Fluid Stains and Underarm Perspiration Stains Tests reported below show that white cotton fibers have a greater tolerance for Scrubbing Bubbles Mildew Stain Remover, Tilex Mildew Remover and Lysol Mildew Remover than for bleaching products like Clorox Bleach. In addition, the spray application and rapid removal of menstrual fluid stain and underarm perspiration stain associated with Scrubbing Bubbles Mildew Stain Remover, Tilex Mildew Remover, Lysol Mildew Remover and Scrub Free Mildew Stain Remover, versus the long immersed soaking process typical of products currently being used for the same purpose, indicate that the mildew removers can be used with greater safety on white cotton fabric.

Observed was the experimental testing of five common household products; (a) dilute Clorox Bleach (sodium hypochlorite, 2.4%), (b) Tilex Mildew Remover (sodium hypochlorite, 2.4%), (c) Lysol Mildew Remover ( sodium hypochlorite, 2.0%), (d) Scrubbing Bubbles Mildew Stain Remover (sodium hypochlorite, proprietary), and (e) Scrub Free Mildew Stain Remover (sodium hypochlorite, proprietary) for the removal of fresh menstrual fluid stain from white cotton (100%) panties. Each of the four mildew remover products was liberally sprayed on a designated one of four panty articles, resulting in excellent removal of the stains from each panty article in less than 1 minute. A pair of similarly soiled panties was soaked in Clorox Bleach for an hour but the test was terminated, with stain still remaining, because of concern for Clorox Bleach damage to the panties. The remaining stain was quickly and successfully treated with one of the mildew remover products.

Two additional white cotton panties with set-in menstrual fluid stain were treated with the product known as Shout® (label instructs the user to soak clothing with set-in stains in Shout overnight or longer) but Shout failed to remove the stains which, subsequently, resisted several wash and dry cycles. Shout® is a designated trademark of S.C. Johnson. These set-in residue stains were sprayed with Tilex Mildew Remover. For the first pair panties, a single spray application of Tilex Mildew Remover completely removed the set-in residue stain in 7 minutes. For the second pair of panties, four spray applications (a total of 15 squirts) and 30 minutes were required for 95%–99% removal of the set-in residue stain. At least a dozen successful tests followed, using the mildew removers on white cotton panties stained with menstrual fluid.

Experimental observations of Clorox Bleach, Scrubbing Bubbles Mildew Stain Remover, Tilex Mildew Remover, Lysol Mildew Remover, and Scrub Free Mildew Stain Remover were conducted to study the extent of physical damage to cotton cloth that may be caused by these products. An approximate 10 $cm^2$ patch of white 100% cotton cloth (panty crotch thickness) was immersed in 10 ml of the Clorox product. Likewise, similar patches were immersed in 10 ml each of the mildew removal products. Within four hours, the patch soaked in Clorox was shredded. After 5 to 6 hours, the patch soaked in Scrub Free Mildew Stain Remover began to shred. After eight hours, the patches soaked in the remaining three mildew removal products were taken out of their solutions, dried, stretched and found to be intact.

Tests were conducted to determine the effectiveness of Scrubbing Bubbles Mildew Stain Remover, Tilex Mildew Remover, Lysol Mildew Remover, and Scrub Free Mildew Stain Remover on perspiration stain, one of the most difficult stains to remove from the underarms of shirts and blouses. A white shirt, 65% polyester and 35% cotton, was the test material. A years-old yellowish-brown perspiration stain was embedded in the seams and fabric of the underarm areas of the sleeves, having stubbornly resisted many wash and dry cycles. The stained areas of the sleeves were immersed in cold water for 30 minutes. Then the stained areas were sprayed liberally with Tilex Mildew Remover and stuffed into a pint-sized plastic container, and allowed to stand for 1 hour. A barely visible yellowish-brown coloration on portions of the seams still remained but this disappeared completely after a brief scrubbing between the hands in the spray product that was left in the fabric. Then the shirt was put through a normal wash and dry cycle. Six undershirts with old, heavily baked-in underarm perspiration stains, assumed impossible to remove, were successfully processed: one by Scrubbing Bubbles Mildew Stain Remover, three by Tilex Mildew Remover, one by Lysol Mildew Remover, and one by Scrub Free Mildew Stain Remover. Scrubbing Bubbles Mildew Stain Remover required 40 minutes to remove completely a stubborn, reddish-brown stain. Tilex Mildew Remover required 30 minutes to remove moderate stains from each of two undershirts. The third undershirt had a heavy, reddish-brown stain which was much more stubborn, similar to that treated by Scrubbing Bubbles Mildew Stain Remover, requiring approximately 75 minutes for complete removal. Lysol Mildew Remover required 30 minutes and Scrub Free Mildew Stain Remover 20 minutes, respectively, for the removal of moderate stains.

In another experiment, the underarm areas of a 65% polyester and 35% cotton shirt with underarm stains was soaked in a Scrubbing Bubbles Mildew Stain Remover spray for the arbitrary period of one hour. The stain was removed with no adverse effects to the garment.

Typical of chlorine-releasing products, such as Tilex Mildew Remover, Lysol Mildew Remover, Scrubbing Bubbles Mildew Stain Remover, and Scrub Free Mildew Stain Remover, are not safe for use with non-colorfast dyes or with silk cloth. A test was conducted to study the extent of physical damage to a pair of pure silk male under briefs soaked in Tilex® Mildew Remover. At 3-½ hours the briefs were damaged to shreds.

The foregoing description of the present invention provides illustration and description, but is not intended to be exhaustive or to limit the invention to the precise one disclosed. Modifications and variations are possible consistent with the above teachings or may be acquired from practice of the invention. Thus, it is noted that the scope of the invention is defined by the claims and their equivalents.

What is claimed is:

1. A method for removing a menstrual fluid or underarm perspiration stain from a soft fabric article, said method comprising the steps of:

(i) providing a cleaner; and (ii) contacting said cleaner with said stain on said soft fabric article for at least one minute, wherein said cleaner comprises;

(a) a surfactant selected from the group consisting of anionic, nonionic surfactants, and mixtures thereof, with optionally, a quaternary ammonium surfactant, the total amount of surfactant being present from about 0.001–10% by weight;

(b) at least one water-soluble or dispersible organic solvent having a vapor pressure of at least 0.001 mm Hg at 25° C., said at least one organic solvent being selected from the group consisting of alkanols, diols, glycol ethers, and mixtures thereof present in an amount from about 1% to 50% by weight of said cleaner;

(c) tetrapotassium ethylenediamine-tetraacetate (potassium EDTA) as a chelating agent, said potassium EDTA present from about 0.01–25% weight-of said cleaner; and (d) water.

2. The method according to claim 1, wherein said soft fabric article is a white cloth.

3. The method according to claim 2, wherein said white cloth is made of cotton or a blend of cotton and polyester.

4. The method according to claim 2, wherein said cloth is selected from the group consisting of panty, shirt, blouse, pant, jean and trousers.

5. The method according to claim 1, said method further comprising the step of scrubbing said soft fabric article to remove said stain.

6. The method according to claim 1, wherein the soft fabric article comprises cotton.

7. The method according to claim 1, wherein said cleaner is contacted with said stain for about 30 minutes.

8. The method according to claim 1, wherein said cleaner is contacted with said stain for about 1 hour.

* * * * *

UNITED STATES PATENT AND TRADEMARK OFFICE

CERTIFICATE OF CORRECTION

PATENT NO. : 6,774,098 B2
DATED : January 8, 2003
INVENTOR(S) : Lawnie H. Taylor It is certified that error appears in the above-identified patent and that said Letters Patent is hereby corrected as shown below:

Title page,
Item [75], Inventors, replace "Taylor, Lawnle H. Germantown, MD (US)" with the following: -- Taylor, Lawnie H. Germantown, MD (US) --

Signed and Sealed this

Twenty-sixth Day of April, 2005

JON W. DUDAS
*Director of the United States Patent and Trademark Office*